US008833551B2

(12) United States Patent
Holford

(10) Patent No.: US 8,833,551 B2
(45) Date of Patent: Sep. 16, 2014

(54) PACK FOR SMOKING ARTICLES

(75) Inventor: Steven Holford, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/882,114

(22) PCT Filed: Sep. 30, 2011

(86) PCT No.: PCT/EP2011/067147
§ 371 (c)(1), (2), (4) Date: Apr. 26, 2013

(87) PCT Pub. No.: WO2012/055672
PCT Pub. Date: May 3, 2012

(65) Prior Publication Data
US 2013/0206618 A1 Aug. 15, 2013

(30) Foreign Application Priority Data
Oct. 28, 2010 (GB) ..... 1018183.2

(51) Int. Cl.
*B65D 85/10* (2006.01)
*A24F 15/12* (2006.01)
*B65D 5/66* (2006.01)

(52) U.S. Cl.
CPC ..... *A24F 15/12* (2013.01); *B65D 85/1045* (2013.01); *B65D 5/6685* (2013.01)
USPC ..... 206/268; 210/273; 229/160.1

(58) Field of Classification Search
CPC .... B65D 43/162; B65D 85/1045; B65D 5/66; B65D 5/6691
USPC ..... 206/268, 271, 273; 220/835, 839; 229/160.1
See application file for complete search history.

(56) References Cited

U.S. PATENT DOCUMENTS 4,733,796 A * 3/1988 Halverstadt et al. ..... 206/268
D613,903 S * 4/2010 Wu et al. ..... D27/189

(Continued)

FOREIGN PATENT DOCUMENTS

DE 102008061661 A1 6/2010
WO 2005/082725 A1 9/2005

(Continued)

OTHER PUBLICATIONS

Search Report and Written Opinion, mailed Nov. 24, 2011, for PCT Application No. PCT/EP2011/067147, filed Sep. 30, 2011.

(Continued)

*Primary Examiner* — David Fidei
(74) *Attorney, Agent, or Firm* — N W Poulsen; L A Pinol

(57) ABSTRACT

A hinged-lid pack (1) for smoking articles is disclosed. The pack (1) comprises a body (2) and a lid (9) hingedly connected to the body along a rear wall of the pack so as to define a line of closure between the lid (9) and the body (2) that extends from the rear wall across opposing side walls and a front wall of the pack. The line of closure (8) has a first portion (30) that extends away from the rear wall across each side wall at a first angle ('A', 'C') relative to the rear wall. The line of closure (8) also has a second portion (31) that extends from the first portion towards the front wall of the pack, the second portion (31) is at a second angle ('B','D') relative to the rear wall.

19 Claims, 4 Drawing Sheets

(56) References Cited

U.S. PATENT DOCUMENTS

| | | | | |
|---|---|---|---|---|
| 2004/0182729 | A1* | 9/2004 | Farrar et al. | 206/349 |
| 2010/0126889 | A1* | 5/2010 | Holford | 206/268 |

FOREIGN PATENT DOCUMENTS

| | | | |
|---|---|---|---|
| WO | 2008/018662 | A1 | 2/2008 |
| WO | 2008/087378 | A1 | 7/2008 |

OTHER PUBLICATIONS

Written Opinion, mailed Sep. 26, 2012, for PCT Application No. PCT/EP2011/067147, filed Sep. 30, 2011.

International Preliminary Report on Patentability, mailed Jan. 29, 2013, for PCT Application No. PCT/EP2011/067147, filed Sep. 30, 2011.

* cited by examiner

PACK FOR SMOKING ARTICLES

CLAIM FOR PRIORITY

This application is a National Stage Entry entitled to and hereby claims priority under 35 U.S.C. §§365 and 371 to corresponding PCT Application No. PCT/EP2011/067147, filed Sep. 30, 2011, which in turn claims priority to GB Application No. 1018183.2, filed Oct. 28, 2010. The entire contents of the aforementioned applications are herein expressly incorporated by reference.

The present invention relates to a pack for smoking articles.

Smoking articles such as cigarettes are typically stored in packs and the overall function of the packs is to store and protect the cigarettes from mechanical and environmental damage. Various configurations of cigarette packs are known from the prior art including hinged-lid and shell packs with slidable inserts or frames. A hinged-lid pack comprises a body and a lid defining a space for holding a bundle of smoking articles. The lid is attached to a rear panel of the body along a hinge-line so that it can rotate between an open and closed position. In a closed position a lower front wall edge of the lid abuts an upper edge of a front panel of the body so as to form a closure line. The closure line typically extends from the rear wall of the pack diagonally downwards across the side walls and then across the front wall of the pack parallel to the hinge-line.

A problem with hinged-lid packs is that the packs may be unstable during manufacturing and folding and so there is a need for improving the configuration of hinged-lid packs so as to provide a pack with increased strength and rigidity during folding.

Another disadvantage of hinged-lid packs is that they are prone to yawning in which the lid sits slightly ajar of the pack and in more extreme cases, the lid may open completely. This may result in moisture loss from the contained product and there is also a risk that some of the contents may fall out. WO08/087378 seeks to overcome this problem by providing a pack having tabs depending from the side walls of the lid which frictionally engage with the body. The present invention seeks to improve the pack known from this document, additionally or alternatively to providing a pack with increased strength and rigidity.

The present invention seeks to provide a pack for holding smoking articles that overcomes or substantially alleviates the problems mentioned above.

According to the present invention, there is provided a hinged-lid pack for smoking articles comprising a body and a lid hingedly connected to the body along a rear wall of the pack so as to define a line of closure between the lid and the body that extends from the rear wall across opposing side walls and a front wall of the pack, wherein the line of closure has a first portion that extends away from the rear wall across each side wall at a first angle relative to the rear wall, the line of closure having a second portion that extends from the first portion towards the front wall of the pack, and at a second angle relative to the rear wall.

Preferably, the first angle is 90° relative to the rear wall of the pack.

In one embodiment, the first angle is at least 60° relative to the rear wall of the pack.

The first angle may be greater than 90° relative to the rear wall of the pack.

Conveniently, the second angle is smaller than the first angle.

The line of closure may be formed with a third portion which extends away from the rear wall towards the first portion, such that the first portion is located between the third and second portion, the third portion being formed at a third angle relative to the rear wall.

Preferably, the third angle of the third portion is similar to the second angle of the second portion.

In one embodiment, the first and third portions of the line of closure extend across at least half of the width of each side wall.

In another embodiment, the first portion extends immediately from the rear wall of the pack. Preferably, the first portion extends across at least half of the width of each side wall.

The lid may be formed with side walls having tabs depending therefrom, the tabs engage with side panels of the body upon opening and closing the lid.

According to another aspect of the invention, there is also a blank for forming the invention referred to above.

Embodiments of the present invention will now be described by way of example only, with reference to the accompanying drawings, in which.

Figure 1:
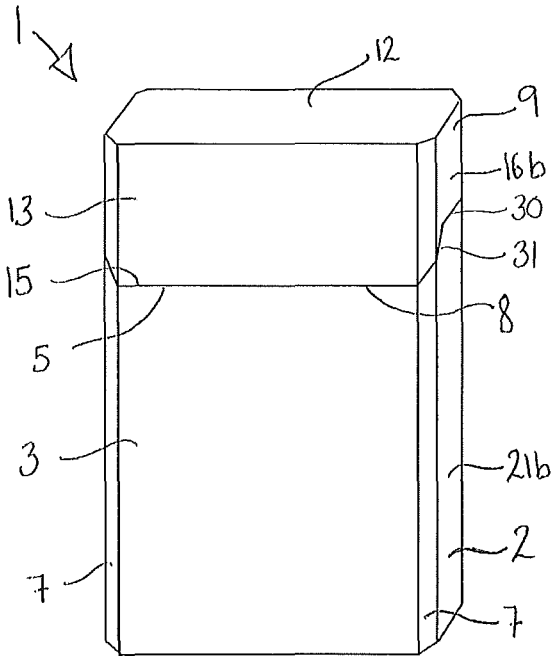
FIG. 1 shows a pack for holding a bundle of smoking articles according to the present invention.
Figure 2:
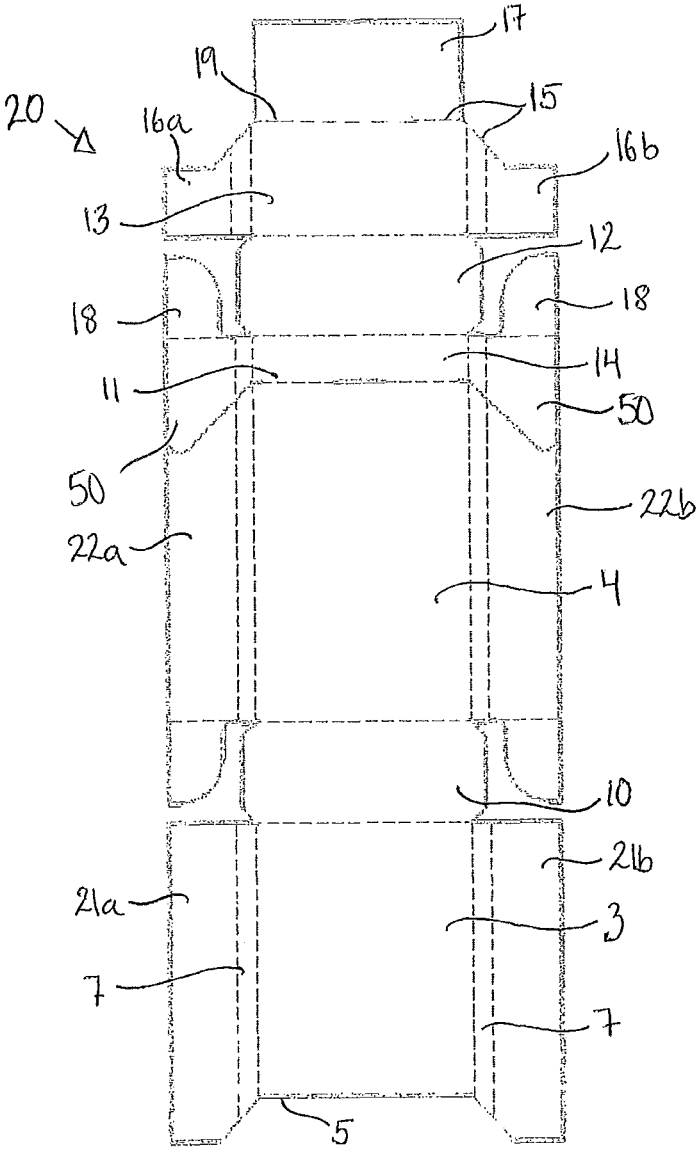
FIG. 2 shows a blank for forming the pack in FIG. 1.
Figure 3:
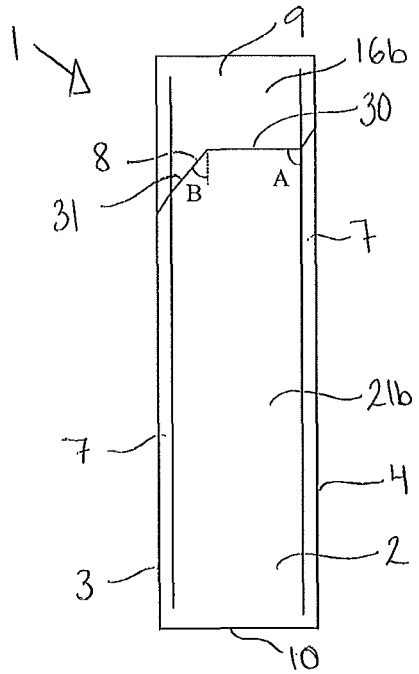
FIG. 3 shows a side view of the pack in FIG. 1.

Referring now to the drawings, there is shown in FIGS. 1 and 3 a pack 1 for holding a bundle of smoking articles according to the present invention. FIG. 2 shows a blank 20 for forming the pack in FIG. 1 where the solid lines denote cut lines or outer borders of the blank 20 and the dashed lines denote lines which are formed by folding. The pack 1 comprises a body 2 and a lid 9 forming a line of closure 8 which is configured to provide increased strength during manufacturing and folding as will become apparent from the description below.

The general configuration of the pack 1 in a folded position will now be described with reference to FIGS. 1 and 3, however some features are not visible in these figures but can be identified in FIG. 2. The body 2 of the pack 1 is formed with opposing front and rear panels 3, 4 separated by two opposing left and right side panels 21*a*, 21*b* as well as a base panel 10. The corners 7 formed at the junctions of the front panel 3 and the side panels 21*a*, 21*b* may be rounded. The front 3 and side panels 21*a*, 21*b* are formed with upper edges 5 which abut corresponding lower edges 15 of the lid 9 so as to form a closure line 8. Thus, the closure line 8 extends from the rear wall 4, 14 of the pack 1 across the rounded corners 7, the opposing side walls 16*a*, 16*b*, 21*a*, 21*b* and the front wall 3, 13 of the pack. The rear panel 4 of the body 2 is connected to a rear wall 14 of the lid 9 along a hinge-line 11. The lid 9 is further provided with a top wall 12, extending between the rear wall 14, a front wall 13 and left and tight side walls 16*a*, 16*b* of the lid 9. The front 13 and side walls 16*a*, 16*b* of the lid 9 are formed with the lower edges 15 which mate with the upper edges 5 of the body 2 when the pack 1 is closed.

As can be appreciated from FIG. 3, the line of closure 8 has a first portion 30 that extends from the corner 7 of the tear wall 4, 14 across at least half of the width of the side wall 16*b*, 21*b*. The first portion 30 is at an angle 'A' relative to the rear wall of the pack. Preferably, the first portion 30 extends at 90° from the rear wall of the pack, however it may extend at an angle less than 90° although the angle should not be less than 60°. Alternatively, the first angle 'A' may extend upwards at an angle greater than 90°. The line of closure 8 is also formed with a second portion 31 that extends from the first portion 30 to the front wall 3, 13 of the pack 1, and is at a second angle 'B' relative to the rear wall 4, 14 of the pack 1. The second angle 'B' is preferably smaller than the first angle 'A'. It should be understood that the closure line extends in a similar manner as described above across the other cornet 7 of the rear wall 4, 14 and the opposing side wall 16*a*, 21*a* of the pack 1.

The advantage of the first portion 30 of the line of closure 8 being angled relative to the rear wall 4, 14 as described above is that it provides stability during manufacturing and folding of the pack 1 compared with conventional packs which typically have a diagonal closure line extending across the side walls all the way from the rear to the front wall of the pack and which generally is at an angle with the rear wall of the pack of around 30°.

In FIG. 2, it can be appreciated that the blank 20 is elongate in shape and comprises the body 2 and the lid 9 of the pack 1 described above. The body 2 of the blank 20 is formed with the front panel 3, the base panel 10 and the rear panel 4. The front panel 3 is formed with the left and right side walls 21*a*, 21*b* which overlap side flaps 22*a*, 22*b* extending from the rear panel 4 when the blank 20 is in a folded position. The dashed lines of the blank located between the front wall 3 and its side walls 21*a*, 21*b*, as shown in FIG. 2, indicate that the corners formed when the blank is folded are rounded.

The lid 9 of the blank 20 further comprises the rear wall 14, top wall 12 and the front wall 13 as previously described. The top and rear walls 12, 14 of the lid 9 are formed with side flaps 18 which are overlapped by the side walls 16*a*, 16*b* of the front wall 13 of the lid 9 when the blank 20 is in a folded position. The front wall 13 of the lid 9 is further formed with a flap 17 extending from the lower front wall edge 15 along a fold-line 19. The flap folds inwardly so that it lies against the inner surface of the front wall 13 of the lid 9. The flap 17 provides stability and strength to the lid as it together with the front wall 13 of the lid 9 form a double layer. The lid is also formed with tabs 50 extending from the side walls 16*a*, 16*b* when the pack is in a folded position. These tabs 50 are optional and the function of the tabs 50 is discussed in more detail below.

Figure 4:
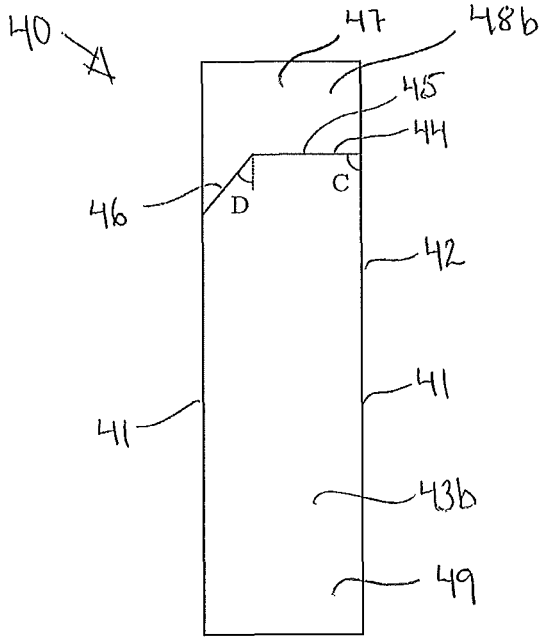
FIG. 4 shows a side view of an alternative embodiment of the pack.

In an alternative embodiment as illustrated in FIG. 4, the pack 40 does not comprise rounded corners as in the embodiment described with reference to FIGS. 1 and 3. Instead, the corners 41 are formed by the rear wall 42 meeting the side walls 43*a*, 43*b* of the pack at 90°. Hence, the first portion 44 of the closure line 45 extends immediately from the rear wall 42 of the pack 40 across at least half the width of the side walls 43*a*, 43*b* of the pack 40 at a first angle 'C' relative to the rear wall 42 of the pack 40. The second portion 46 of the closure line extends from the first portion 44 to the front wall 47 of the pack at a second angle 'D' to the rear wall 41 of the pack 40. Similar to the embodiment described with reference to FIGS. 1 and 3, the second angle 'D' is preferably smaller than the first angle 'C' and the first portion 44 extends for at least half the width of the side walls 43*a*, 43*b*.

Figure 5:
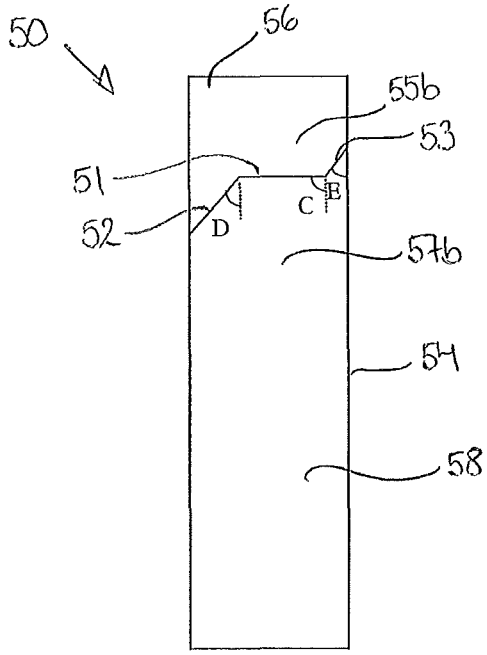
FIG. 5 shows a side view of another alternative embodiment of the pack.

In another alternative embodiment as shown in FIG. 5, the pack 50 is formed with right angled corners similar to the pack shown in FIG. 4, however the closure line comprises a third portion 53 which extends away from the rear wall 54 towards the first portion 51 such that the first portion 51 is located between the second 52 and the third portion 53. The third portion 53 is at an angle 'E' relative to the rear wall 54 of the pack. Preferably, angle 'E' is smaller than the first angle 'C' of the first portion 51. Furthermore, it is envisaged that the third angle 'E' is similar to the second angle 'D' of the second portion 52.

It is also envisaged that the embodiments of the packs 1, 40, 50 described above may be formed with tabs 50 depending from the side walls 16*a*, 16*b*, 48*a*, 48*b*, 55*a*, 55*b* of the lid 9, 47, 56. The tabs 50 engage with inner surfaces of the side panels 21*a*, 21*b*, 43*a*, 43*b*, 57*a*, 57*b* of the body 2, 49, 58 thereby reducing yawning and accidental opening of the pack 1, 40, 50. The pack 1 shown in FIGS. 1 and 3 and its respective blank 20 illustrated in FIG. 2, is provided with tabs and will now be described, however it should be appreciated that the packs 40, 50 illustrated in FIGS. 4 and 5 may also be provided with tabs and function similarly to the description below.

The advantage of the pack 1 having a closure line 8 of which the first portion 30 being angled to the rear wall 4, 14 of the pack 1 as described above is that the tabs 50 engage with the inner surface of the side panels 21*a*, 21*b* of the body 2 through a larger opening angle compared to conventional packs having a closure line extending at a much smaller angle relative to the rear wall 4, 14 of the pack 1. Thus, the section of side panels 21*a*, 21*b* of the body 2 forming the first portions 30 of the closure line together with the side walls 16*a*, 16*b* of the lid 9 provide greater aid for aligning the tabs 50 within the pack 1 upon closing than conventional packs. The effect of the tabs 50 engaging with the side panels 21*a*, 21*b* of the body 2 through a large opening angle is also achieved by the first portion 30 extending across at least half of the width of the side walls 16*a*, 16*b*, 21*a*, 21*b* of the pack 1. This is because the further the first portion 30 extends across the side wall 16*a*, 16*b*, 21*a*, 21*b* of the pack 1 the sooner the tabs 50 will engage with the inner surface of the side panels 21*a*, 21*b* of the body 2 upon closing the lid 9. However, in a preferred embodiment the first portion 30 does not extend across the whole width of the side walls 16*a*, 16*b*, 21*a*, 21*b* at 90° relative to the rear wall 4, 14 of the pack 1, as this would interfere with the tabs 50 upon closing the lid. Instead, the second portion 31 is formed at a smaller angle than the angle 'A' of the first portion 30 so as to enable the lid 9 to be closed and for the tabs 50 to locate adjacent to the inner surface of the side panels 21*a*, 21*b* of the body 2.

Another advantage of the closure line having steps formed by the first and the second portions, as well as the third portion, is that the angles 'A', 'B', 'C', 'D' and 'E' can be formed to be less acute than the angle of a diagonal closure line of a conventional pack. This reduces the sharpness of the points or corners formed at these angles and so potential damage or delamination of the cardboard at these points is minimised.

It is envisaged that any of the embodiments described above may include a frame, wherein the frame is inserted to the pack to provide additional protection to the smoking articles.

Although embodiments of the invention have been shown and described, it will be appreciated by those persons skilled in the art that the foregoing description should be regarded as a description of preferred embodiments only and that other embodiments that fall within the scope of the appended claims are considered to form part of this disclosure.

The invention claimed is:

1. A hinged-lid pack for smoking articles comprising:

a body comprising a body front wall, a body rear wall, left and right body side walls, and a base, wherein the left and right body side walls each overlap a respective side flap; and a lid comprising a lid front wall, a lid rear wall, two opposing lid side walls, and a top wall;

wherein the lid is hingedly connected to the body along a rear wall of the pack so as to define a continuous, externally-facing line of closure between the lid and the body that extends from the rear wall of the pack across opposing pack side walls and a front wall of the pack, wherein the line of closure has:

a first portion that extends away from the rear wall of the pack across each pack side wall at a first angle relative to the rear wall of the pack;

a second portion that extends from the first portion to the front wall of the pack, and at a second angle relative to the rear wall of the pack; and a third portion that extends away from the rear wall of the pack towards the first portion, such that the first portion located between the third and the second portion, the third portion being formed at a third angle relative to the rear wall of the pack, wherein the angles are measured within the plane of a body side wall, and wherein the second angle is smaller than the first angle.

2. The hinged-lid pack according to claim 1, wherein the first angle is about 90° relative to the rear wall of the pack.

3. The hinged-lid pack according to claim 1, wherein the first angle is at least 60° relative to the rear wall of the pack.

4. The hinged-lid pack according to claim 1, wherein the first angle is greater than 90° relative to the rear wall of the pack.

5. The hinged-lid pack according to claim 1, wherein the third angle of the third portion is similar to the second angle of the second portion.

6. The hinged-lid pack according to claim 1, wherein the first and third portions extend across at least half of the width of each side wall.

7. The hinged-lid pack according to claim 1, wherein each of the lid side walls comprises a tab depending therefrom, the tabs configured to engage with side panels of the body upon opening and closing the lid.

8. A hinged-lid pack for smoking articles, comprising:

a lid comprising a lid front wall, a lid rear wall, two opposing lid side walls, and a top wall;

a body comprising a body front wall, a body rear wall, left and right body side walls wherein the left and right side walls each overlap a respective side flap, and a base, the body hingedly connected to the lid along a rear wall of the pack so as to define an externally-facing line of closure between the body and the lid that extends from the rear wall of the pack across opposing pack side walls and a front wall of the pack, the lid side walls each including an engagement tab depending therefrom, the engagement tabs configured to engage with inner side surfaces of the body upon opening and closing the lid;

wherein the line of closure has a first portion that extends away from the rear wall of the pack across each pack side wall at a first angle relative to the rear wall of the pack, the line of closure having a second portion that extends from the first portion to the front wall of the pack, and at a second angle relative to the rear wall of the pack;

wherein the angles are measured within the plane of a body side wall; and wherein the second angle is smaller than the first angle.

9. The hinged-lid pack according to claim 8, wherein the first angle is about 90° relative to the rear wall of the pack.

10. The hinged-lid pack according to claim 8, wherein the first angle is at least 60° relative to the rear wall of the pack.

11. The hinged-lid pack according to claim 8, wherein the first angle is greater than 90° relative to the rear wall of the pack.

12. The hinged-lid pack according to claim 8, wherein the first portion extends immediately from the rear wall of the pack across at least half of the width of each side wall.

13. The hinged-lid pack according to claim 8, wherein at least one body side wall, based on the angles, is configured to engage with one or more tabs through a larger opening angle than that of a conventional pack, the conventional pack having a diagonal closure line extending across its side walls from a rear wall to a front wall thereof and at an angle with the rear wall of the conventional pack of about 30°.

14. A hinged-lid pack for smoking articles, comprising:

a body comprising a body front wall, a body rear wall, left and right body side walls, and a base, wherein the left and right body side walls each overlap a respective side flap; and a lid comprising a lid front wall, a lid rear wall, two opposing lid side walls, and a top wall, the lid hingedly connected to the body along a rear wall of the pack so as to define an externally-facing line of closure between the lid and the body that extends from the rear wall of the pack across opposing pack side walls and a front wall of the pack;

wherein the line of closure has:

a first portion that extends away from the rear wall of the pack across each pack side wall at a first angle relative to the rear wall of the pack;

a second portion that extends from the first portion to the front wall of the pack, and at a second angle relative to the rear wall of the pack, wherein the angles are measured within the plane of a body side wall, and wherein the second angle is smaller than the first angle; and wherein at least one body side wall, based on the angles, is configured to engage with one or more tabs through a larger opening angle than that of a conventional pack, the conventional pack having a diagonal closure line extending across its side walls from a rear wall to a front wall thereof and at an angle with the rear wall of the conventional pack of about 30°.

15. The hinged-lid pack according to claim 14, wherein the first angle is about 90° relative to the rear wall of the pack.

16. The hinged-lid pack according to claim 14, wherein the first angle is at least 60° relative to the rear wall of the pack.

17. The hinged-lid pack according to claim 14, wherein the first angle is greater than 90° relative to the rear wall of the pack.

18. The hinged-lid pack according to claim 14, wherein the first portion extends immediately from the rear wall of the pack across at least half of the width of each side wall.

19. The hinged-lid pack according to claim 14, wherein the lid side walls include tabs depending therefrom, the tabs configured to engage with sides of the body upon opening and closing the lid.

* * * * *

UNITED STATES PATENT AND TRADEMARK OFFICE

CERTIFICATE OF CORRECTION

PATENT NO. : 8,833,551 B2
APPLICATION NO. : 13/882114
DATED : September 16, 2014
INVENTOR(S) : Steven Holford It is certified that error appears in the above-identified patent and that said Letters Patent is hereby corrected as shown below:

In the Claims

Column 5, line 12, "located between the third and the second portion," should read -- is located between the third and the second portion, --

Signed and Sealed this
Twenty-fourth Day of February, 2015

Michelle K. Lee

Michelle K. Lee
*Deputy Director of the United States Patent and Trademark Office*